US008230655B2

(12) United States Patent
Kallweit

(10) Patent No.: US 8,230,655 B2
(45) Date of Patent: Jul. 31, 2012

(54) UNDER RAFTER INSULATION SYSTEM FOR A HIGH PITCHED ROOF

(75) Inventor: Gerhard Kallweit, Bottrop (DE)

(73) Assignee: Deutsche Rockwool Mineralwoll GmbH (DE)

( * ) Notice: Subject to any disclaimer, the term of this patent is extended or adjusted under 35 U.S.C. 154(b) by 311 days.

(21) Appl. No.: 12/516,315

(22) PCT Filed: Oct. 19, 2007

(86) PCT No.: PCT/EP2007/009078

§ 371 (c)(1),
(2), (4) Date: Jul. 20, 2009

(87) PCT Pub. No.: WO2008/064743

PCT Pub. Date: Jun. 5, 2008

(65) Prior Publication Data

US 2010/0043328 A1 Feb. 25, 2010

(30) Foreign Application Priority Data

Nov. 27, 2006 (DE) ..... 10 2006 055 850

(51) Int. Cl.

| | |
|---|---|
| ***E04B 1/74*** | (2006.01) |
| ***E04B 5/00*** | (2006.01) |
| ***E04B 2/00*** | (2006.01) |
| ***E04B 1/38*** | (2006.01) |

(52) U.S. Cl. ..... 52/407.3; 52/404.1; 52/407.2; 52/407.4; 52/404.3; 52/404.5; 52/506.05; 52/702; 52/408; 52/410; 52/712

(58) Field of Classification Search ..... 52/404.1, 52/407.2–407.4, 404.3, 404.5, 506.05, 702, 52/408, 410, 712

See application file for complete search history.

(56) References Cited

U.S. PATENT DOCUMENTS

| | | | | | |
|---|---|---|---|---|---|
| 2,580,231 | A | * | 12/1951 | Lamm | 248/67.7 |
| 3,513,614 | A | * | 5/1970 | Studzinski | 52/742.12 |
| 4,111,096 | A | * | 9/1978 | Fasth | 411/478 |
| 4,244,269 | A | * | 1/1981 | Gorell | 411/477 |
| 4,292,777 | A | * | 10/1981 | Story | 52/407.1 |
| 4,471,592 | A | * | 9/1984 | MacKinnon et al. | 52/404.2 |
| 4,476,659 | A | * | 10/1984 | Player | 52/404.1 |

(Continued)

FOREIGN PATENT DOCUMENTS

DE 28 29 626 A 2/1980

(Continued)

*Primary Examiner* — Brian Glessner
*Assistant Examiner* — Omar Hijaz
(74) *Attorney, Agent, or Firm* — Harness, Dickey & Pierce, P.L.C.

(57) ABSTRACT

The invention relates to an under rafters insulation system for a steep roof, comprising at least two mutually parallel extending building elements (3) which are spaced from each other, and insulation elements (4), in particular mineral fiber insulation elements, are arranged in a space between the building elements (3). The building elements (3) are mountable to rafters (2) of the steep roof by means of holding elements (5). For further developing an under rafters insulation system of the described type to the effect that the insulation elements (4) are easily supported between the building elements (3) at least over a period of time in which the under rafters insulation system (1) is not yet completed with a final cover, it is proposed that the holding elements (5) additionally secure the insulation elements (4) against falling out of the space between the building elements (3).

7 Claims, 6 Drawing Sheets

U.S. PATENT DOCUMENTS

Figure 1:
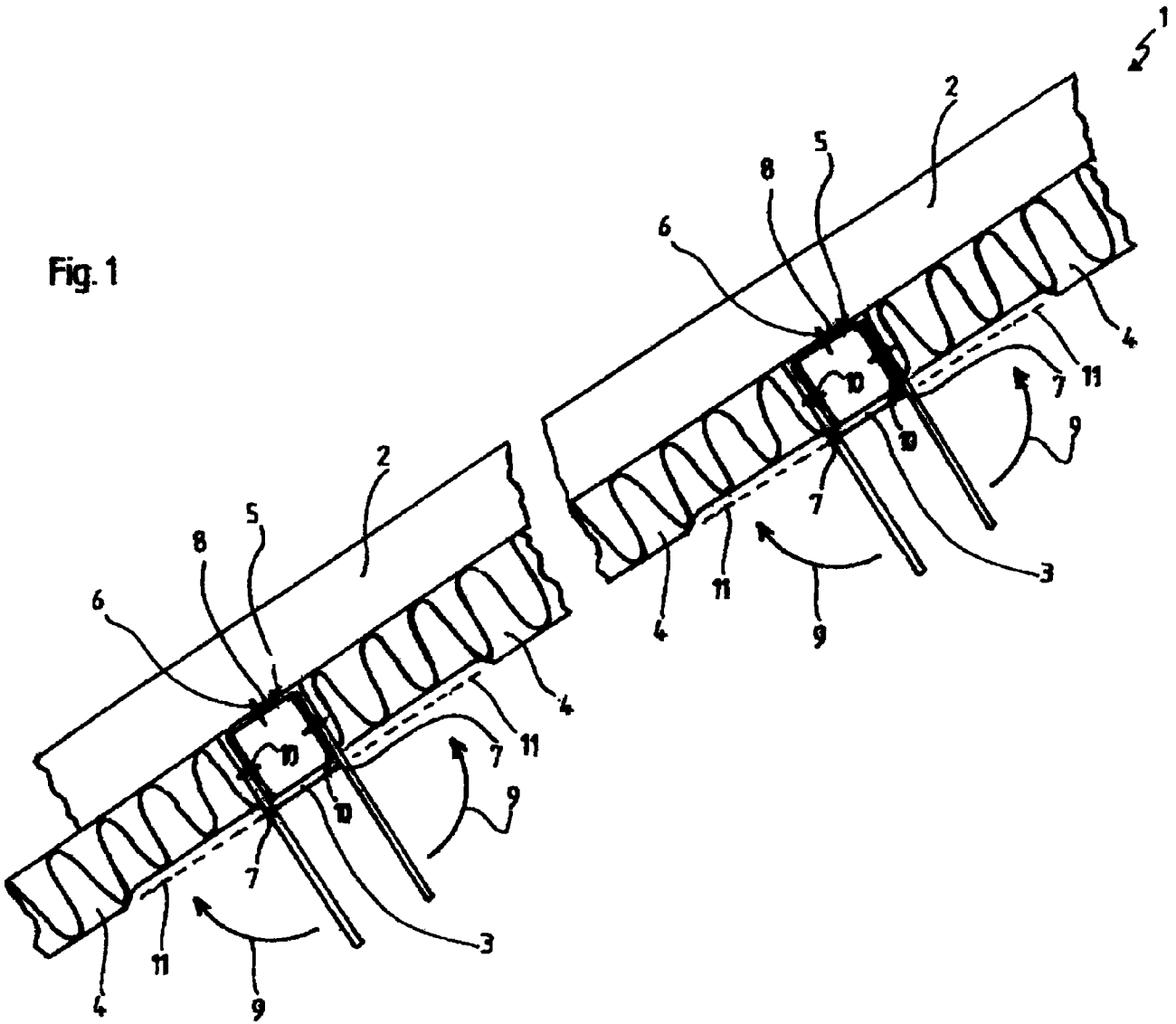

| | | | | | |
|---|---|---|---|---|---|
| 4,512,130 | A | * | 4/1985 | Pepin | 52/404.2 |
| 4,545,166 | A | * | 10/1985 | Kielmeyer | 52/506.06 |
| 4,602,468 | A | * | 7/1986 | Simpson | 52/410 |
| 4,606,160 | A | * | 8/1986 | Kubbutat | 52/235 |
| 4,653,241 | A | * | 3/1987 | Bindi | 52/169.11 |
| 5,581,966 | A | * | 12/1996 | Fligg | 52/404.3 |
| 6,122,867 | A | * | 9/2000 | Leconte | 52/144 |
| 6,487,825 | B1 | * | 12/2002 | Sillik | 52/404.1 |
| 2007/0068104 | A1 | * | 3/2007 | Weir et al. | 52/404.1 |

FOREIGN PATENT DOCUMENTS

| | | | |
|---|---|---|---|
| DE | 200 06 759 | U | 6/2000 |
| FR | 2 636 657 | A | 3/1990 |
| FR | 2 807 082 | A | 10/2001 |

* cited by examiner

UNDER RAFTER INSULATION SYSTEM FOR A HIGH PITCHED ROOF

The invention relates to an under rafters insulation system for a steep roof, comprising at least two mutually spaced and parallel extending building elements and insulation elements, in particular mineral fiber insulation elements, arranged in a space between the building elements, wherein the building elements are mountable to rafters of the steep roof by means of holding elements.

Under rafters insulation systems for a steep roof are known from prior art. These systems are insulation systems which are arranged in addition to between rafters insulation systems intermediate of counter-laths arranged under the rafters. Such an under rafter insulation system is normally composed of insulation elements which are wedged for instance between the counter-laths. Since the thermal transmission resistance increases with an increasing bulk density of insulation elements made of mineral fibers and since the production of such highly compressed insulation elements is expensive and makes their processing/handling more difficult, it is advantageous in the field of roof insulation to process insulation elements having a relatively low bulk density and hence a low inherent stiffness. Moreover, in the under rafters insulation system insulation elements having a low material thickness are processed which in turn have only a low inherent stiffness, so that the clamping of these insulation elements is made more difficult. During installation, these insulation elements are compressed parallel to the large surfaces.

To the counter-laths cover elements such as plaster board panels are finally fixed. Now the problem exists that the insulation elements tend to fall out of the space formed between the counter-laths, until they are fixed to the cover elements.

This problem is solved for example by an under rafters insulation system according to DE 20006 759 U1. From this document an under rafters insulation system is known comprising a holding device for securing the insulation elements against falling out of the intermediate space between the counter-laths. This holding device can consist for example of bracket having a U-shaped cross section and two legs as well as a web interconnecting the legs, and on the free end of the legs outwardly directed sections are arranged extending parallel to the web. This bracket is pushed over a counter-lath, so that the legs extend in the direction of the surface normal of the insulation elements in the between rafters insulation. The insulation elements of the under rafters insulation can then be placed onto the sections arranged on both sides.

This fixing element has the disadvantage that the installation between the counter-lath system and the already previously installed between rafters insulation system frequently results in the insulation elements of the between rafters insulation or a steam barrier covering the between rafters insulation towards the room being damaged. From this document a further holding device is known which consists of flat elements which are fixed to the counter-laths. Fixing takes place for example by means of screws or nails. This embodiment of the holding device increases the working time for constructing the between rafters insulation.

Finally a further holding device is known from this document, which consists of an adhesive that is applied to non-laminated surfaces of the panel sections of the between rafters insulation. Applying additional adhesive may lead to that the fire protection properties of an insulation system constructed in this way are no longer satisfied. Incidentally, also this technique is unsatisfying, because especially the rigidity of mineral wool insulation elements having a low bulk density is not sufficient for securely preventing adhered insulation elements from tearing off.

In the above-described under rafters insulation system the counter-laths are usually made of wood and are nailed or screwed to the rafters. An alternative embodiment provides the use of profiles instead of counter-laths, and preferably profiles are used which have a U-shaped cross section. These profiles have two legs and a web interconnecting the legs, and the legs are arranged in same directions at right angles to the web.

During proper mounting, the legs of the profiles are oriented obtusely towards the rafters, so that the web of the profile is positioned at a distance to the surfaces of the rafters. Inside the space between the leg of the profile and the surfaces of the rafters, electric lines can be laid for example.

Mounting of the profiles to the rafters takes place by means of L-shaped angle elements which are screwed to a leg of the profile on one side and to a surface of the rafter on the other side.

In view of the above-described prior art the invention is based on the problem of improving an under rafters insulation system of the type described to the effect that the insulation elements are supported in an easy way between the building elements, at least for a period of time in which the under rafters insulation system is not yet completed with a final cover.

The solution of the problem provides that in an under rafters insulation system according to the present invention the holding elements additionally secure the insulation elements against falling out of a space between the building elements.

Prior art does not provide such holding elements, at least if U-shaped profiles are used as building elements. Only if the under rafters insulation system is constructed with a counter-lath system additional holding devices are provided for securing the insulation elements against falling out of the intermediate space between the counter-laths.

The invention now provides that additional holding devices can be dispensed with and that the holding elements are instead used not only for mounting the building elements but additionally also for securing the insulation elements in the space between the building elements.

An advantageous construction of the under rafters insulation system of the invention provides that the holding elements are substantially U-shaped or L-shaped and include a leg for mounting to the rafter and a second leg extending substantially at right angles to the first leg for mounting to the building element, the second leg having a free end which can be bent over towards the insulation element after its mounting to the building element, in order to be placed into contact with the surface of the insulation element. Accordingly, this embodiment of the under rafters insulation system of the invention has the important advantage that a small number of components allows secure fixing of the insulation elements arranged between the building elements. Additional holding devices can normally be dispensed with in the construction according to the invention, although such devices may be useful for securing the insulation elements, as described in the following.

A further feature of the invention provides that the building elements are formed as profiles with a substantially U-shaped cross section. These profiles offer the advantage that the hollow space between the profiles and the rafters is available for accommodating energy lines such as electric cables for instance.

According to a further feature of the invention it turned out to be beneficial that the holding elements are made from a plastically deformable material, in particular from thin metal sheets. This arrangement makes the handling of the holding elements much easier, because the same can be installed in their L-shape before the leg protruding over the building element is bent over towards the insulation elements.

A further feature of the invention preferably provides that the holding elements are formed as perforated metal sheets. If formed in this way, mounting of the holding devices to the rafters on one side or to the building element on the other side can be arranged to be variable. The configuration of the holding element as a perforated metal sheet is also advantageous to the effect that the final bending operation can be easily performed. Finally it should be appreciated that, though clearly reduced in weight, the corresponding building elements still have sufficient stability for satisfying the stated requirements.

A supplementing construction of the under rafters insulation system provides that the profiles can be connected in a form-fit fashion to at least one mounting bracket that extends into the space between the profiles and secures the insulation element against falling out. Normally the profiles extend at right angles to the extension of the rafters, overlapping several arrays of rafters, and are fixed to the mutually spaced parallel extending rafters. Depending on the spacing between the rafters, a more or less wide array of rafters is produced.

In the under rafters insulation system according to the invention the insulation elements are secured in the region of the rafters by the holding elements. If the spacing between the rafters is relatively wide or if the insulation elements, in particular those from mineral fibers, have a low inherent stability, e.g. a low bulk density, additional support may be required for the insulation elements in the region of the rafter arrays between the rafters and the profiles there arranged. For this purpose mounting brackets are provided that can be connected to a profile in a form-fit fashion.

It should be noted that these mounting brackets can of course be used also independently of the above-described holding elements. Accordingly, in the construction of the under rafters insulation system according to the invention the holding elements do not play a decisive part if the insulation elements are supported by a plurality of mounting brackets in the space between the building elements. This construction is given for instance if the building elements are mounted to the rafters by means of usual fixing elements that do not extend beyond the outer surface of building elements, so that these fixing elements are merely provided to fix the building elements to the rafters.

Further it should be noted that the above-described embodiments of the invention are not limited to the use of profiles as building elements. It is rather possible to implement the construction of an under rafters insulation system according to the invention also with a counter-lath system, wherein the counter-laths are fixed to the rafters through holding elements.

According to a further development of this embodiment the mounting bracket is substantially L-shaped and mountable to the profile in a form-fit fashion by one leg thereof. The second leg, which extends at right angles to the first leg, overlaps at least one insulation element if it is arranged on the profile in accordance with its intended purpose.

Preferably, the mounting bracket includes a seat which overlaps a free end of one leg of the profile. Additionally a protrusion formed in the transition zone between one leg and a web of the U-shaped profile can be arranged in the transition zone from the first to the second leg, so that the mounting bracket is connected to the profile at least partially in a form-fit fashion and in a force-fit fashion for the rest of it.

According to a further feature it turned out to be advantageous to construct the mounting bracket from a rigid material, in particular metal or a plastic material, to securely support also insulation elements having a higher weight. Concerning a construction from a plastic material, a reduced own weight and a reduced thermal conductivity can be emphasized compared to a metal mounting bracket.

A further feature of the invention finally provides that the mounting bracket consists of a thin metal sheet which preferably has a material thickness<0.75 mm and is at least partly formed with a bead. Here the bead serves to reinforce the mounting bracket from a very thin metal sheet, so as to achieve the required stability of the mounting bracket, which additionally has a low-weight construction.

Figure 2:
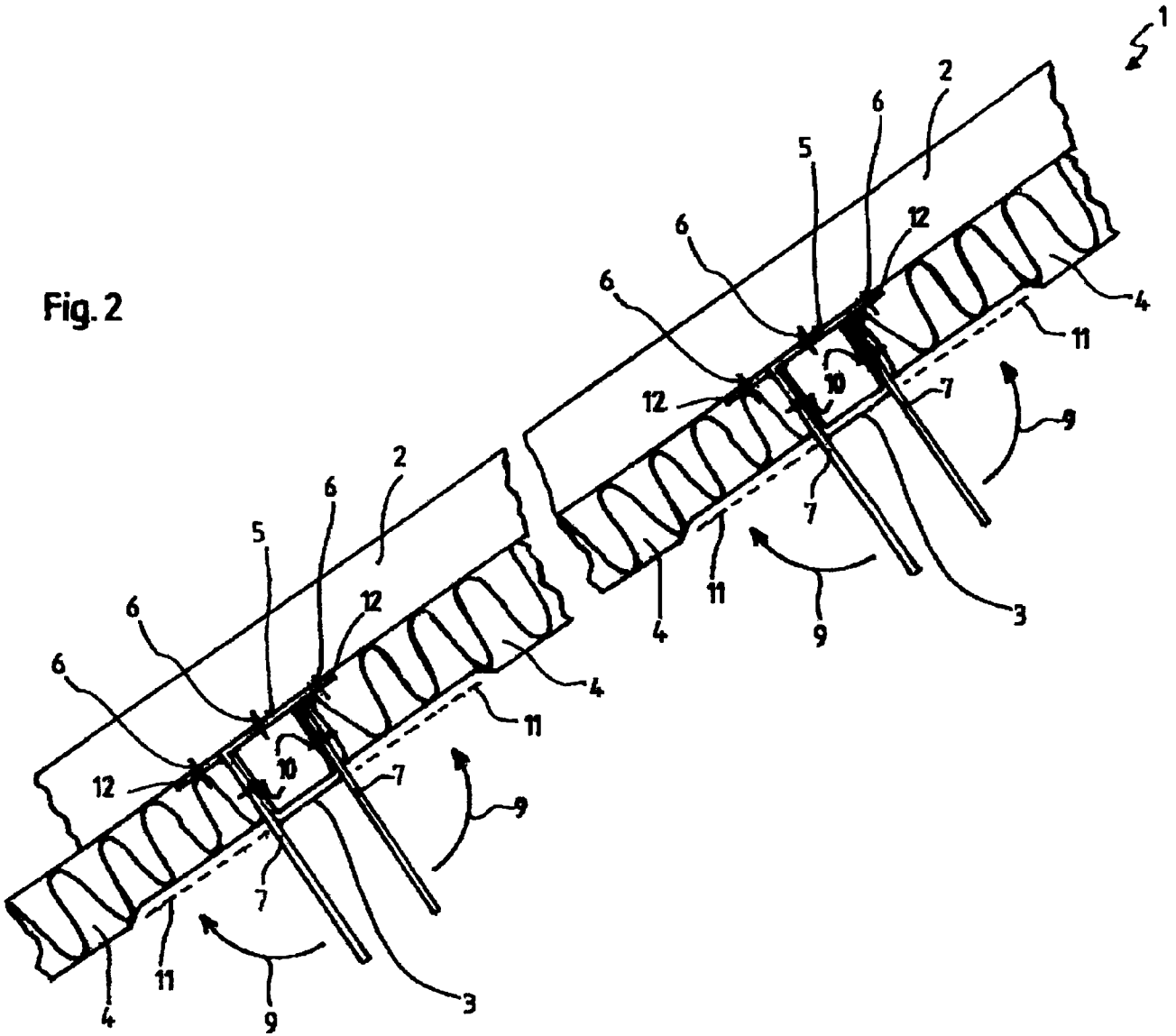
Figure 3:
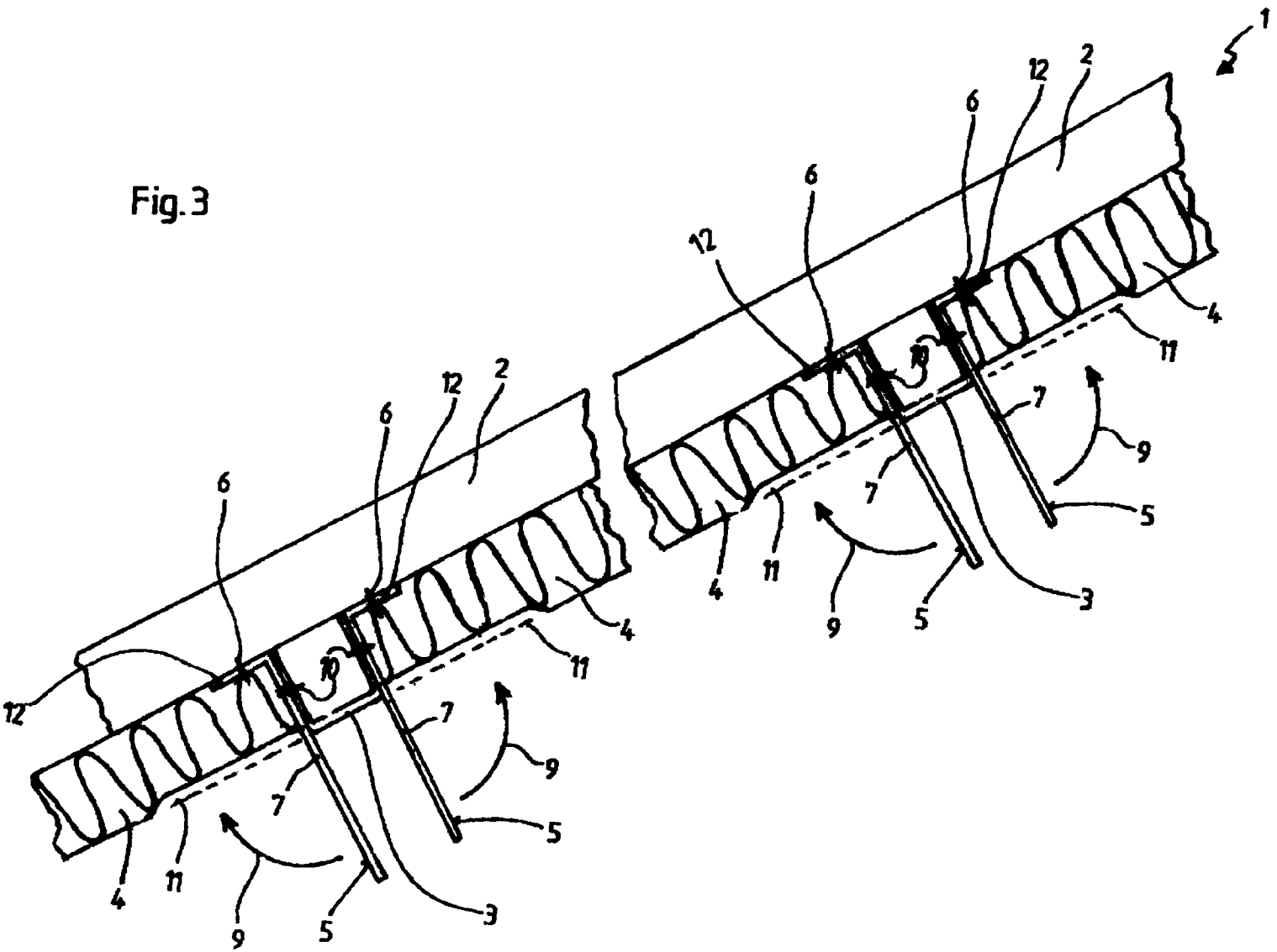
Figure 4:
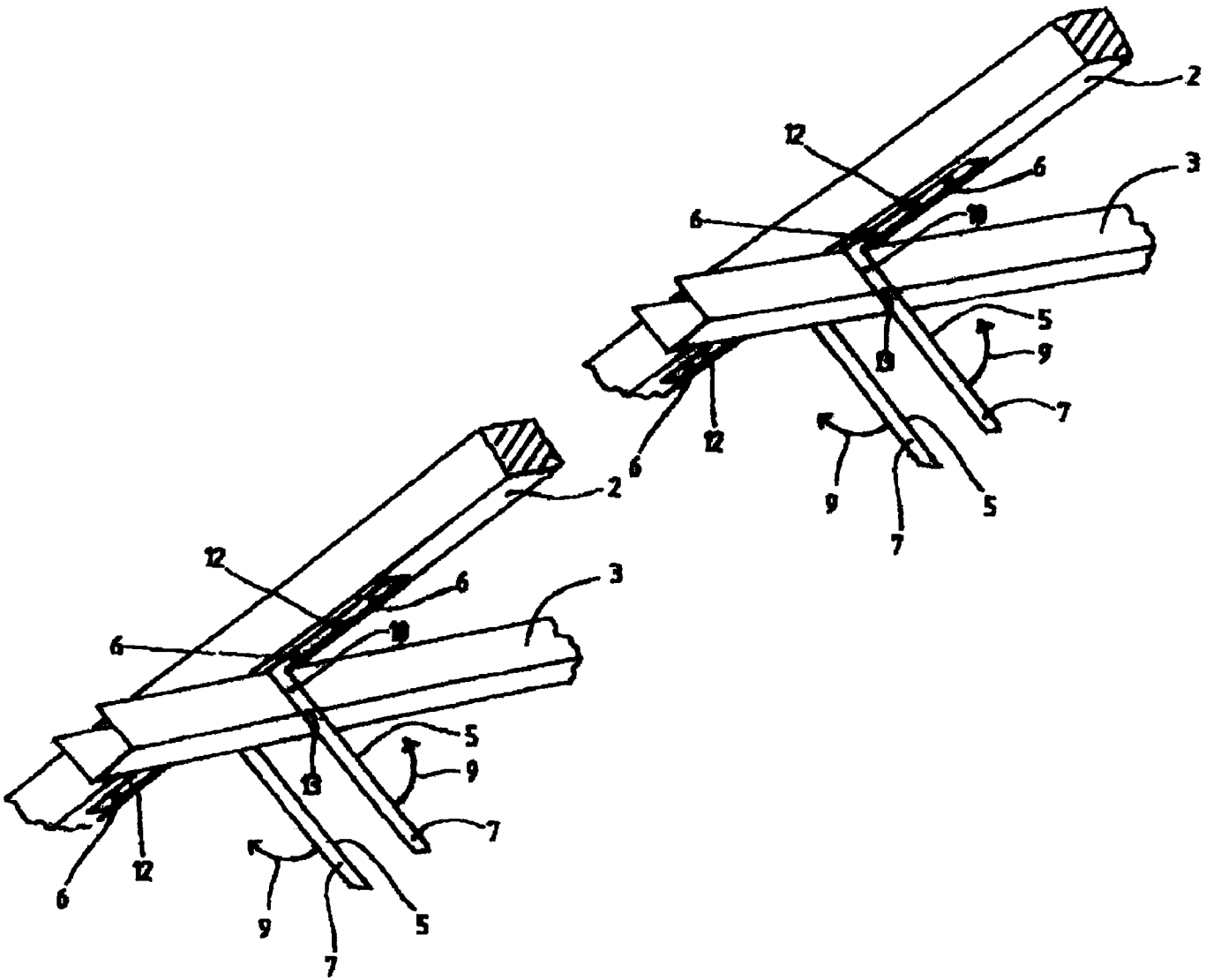
Figure 5:
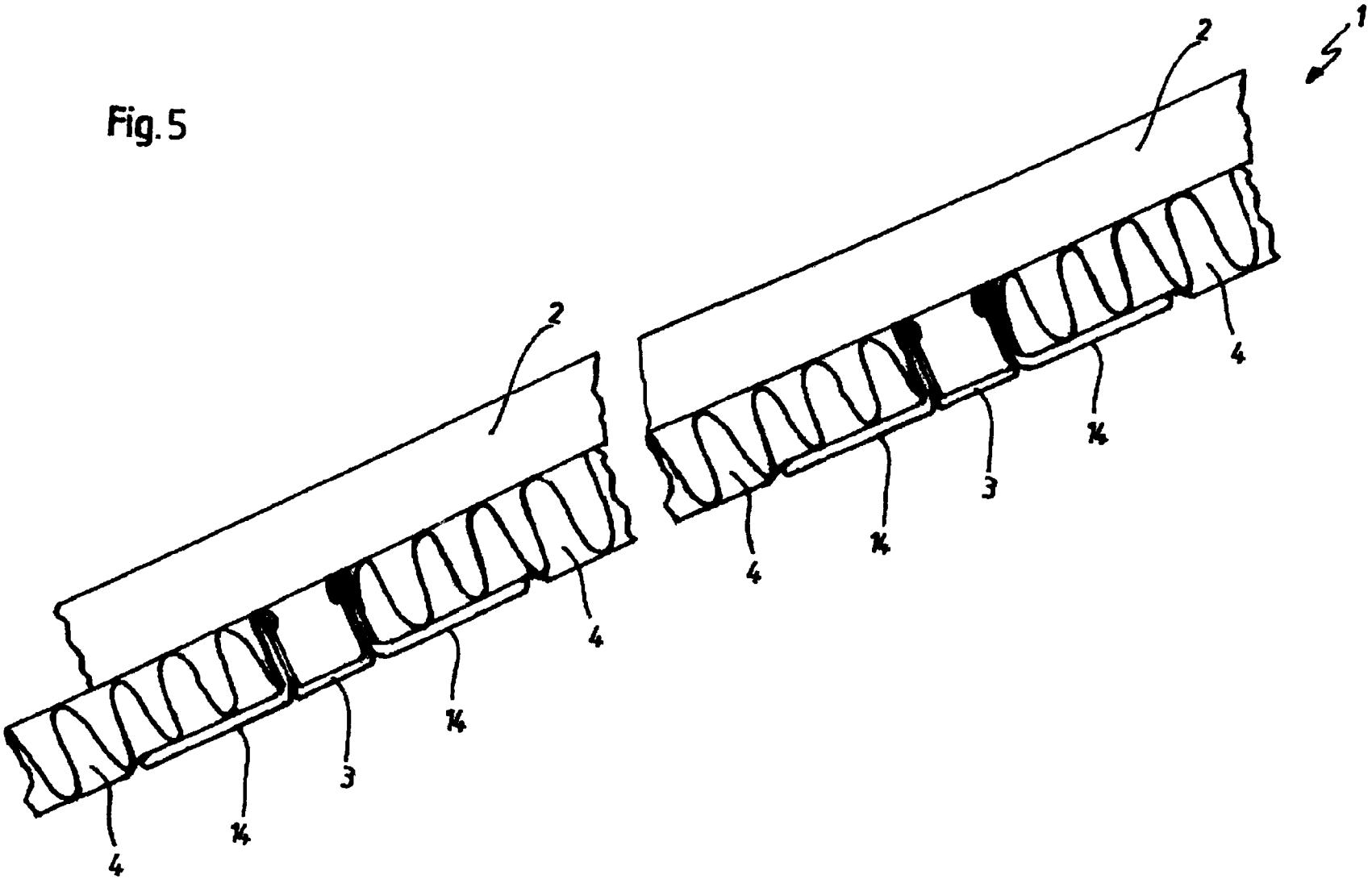
Figure 6:
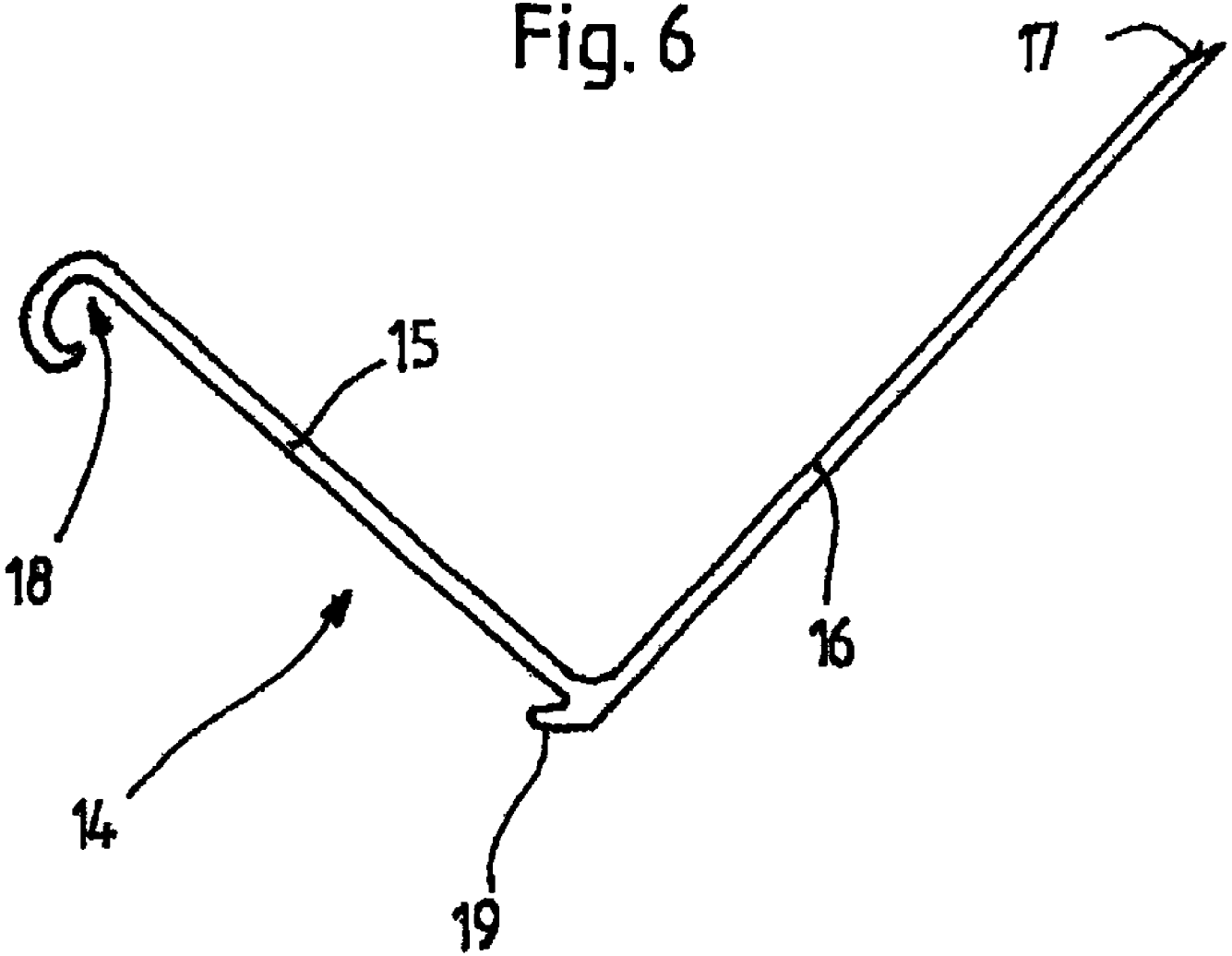

Further features and advantages of the invention will become apparent from the following description of the attached drawing showing preferred embodiments of a under rafters insulation system according to the invention. In the drawing it is shown by:

FIG. 1 a first embodiment of a section of a under rafters insulation system in a lateral view;

FIG. 2 a second embodiment of a section of an under rafters insulation system in a lateral view;

FIG. 3 a third embodiment of a section of an under rafters insulation system in a lateral view;

FIG. 4 a part of the under rafters insulation system according to FIG. 3, in a perspective view;

FIG. 5 a fourth embodiment of a section of an under rafters insulation system in a lateral view and FIG. 6 a mounting bracket for use in an under rafters insulation system according to FIG. 5, in a lateral view.

The FIGS. 1 to 3 and 5 illustrate four embodiments of an under rafters insulation system 1 which is arranged under rafters 2 of a steep roof not further shown. The under rafters insulation system 1 is composed of at least two mutually spaced and parallel extending building elements in the form of profiles 3 having a U-shaped cross section, and insulation elements 4, namely mineral fiber insulation elements, are arranged between the profiles. The profiles 3 are connected to the rafters 2 by means of holding elements 5. For this purpose screw connections 6 are provided, by which the holding elements 5 are screwed to the rafters 2.

FIG. 1 shows a holding element 5 which is substantially U-shaped and includes two legs 7 and a web 8 extending at right angles to the legs. The web 8 is connected to the rafters 2 through the screw connection 6.

It can be seen from FIG. 1 that the legs 7 have a length which is greater than the height of the profile 3, so that the legs 7 protrude over a surface which is defined by a web of the profile 3.

The holding element 5 is constructed from a thin metal sheet, so that the legs 7 can be easily bent onto the insulation elements 4 in the direction of the arrows 9 to additionally secure the insulation elements 4 against falling out of the space between the profiles 3.

The profile 3 is connected to the legs 7 of the holding element 5 through additional screw connections 10.

The final position of the legs 7 after folding towards the insulation elements 4 is illustrated in the above-mentioned figures by means of a broken line 11.

FIG. 2 shows a second embodiment of an under rafters insulation system 1. This second embodiment is different from the embodiment according to FIG. 1 in that the holding element 5 is L-shaped. Two holding elements 5 are arranged side by side on a rafter 2, and the legs 12, which rest on the rafters 2, are oriented in opposite directions and each leg grips under the profile 3. Otherwise the embodiment according to FIG. 2 corresponds to the embodiment according to FIG. 1.

FIG. 3 shows a third embodiment of an under rafters insulation system 1 which is directly comparable to the embodiment according to FIG. 2, because also in this embodiment the holding elements 5 are substantially L-shaped. But differently from the embodiment according to FIG. 2, the embodiment according to FIG. 3 provides that the legs 12 of the holding element 5 do not grip under the profile 3, so that the profile 3 is butt-joined to an outer surface of the rafters 2 by its legs.

FIG. 4 shows in a perspective view a rafter 2, a profile 3 and two holding elements 5. Compared to FIGS. 1 to 3, FIG. 4 additionally shows a bending point 13 of the holding element 5. Further it can be seen that the legs are slightly bent toward each other on their free ends, to facilitate for instance the insertion of the insulation elements 4 in such a way that the surface regions of the insulation elements 4 are not damaged by the free ends of the legs 7 if the legs 7 have already been bent over.

FIGS. 5 and 6 show an alternative embodiment of an under rafters insulation system or a mounting bracket 14 used in this under rafters insulation system.

The mounting bracket according to FIG. 14 is L-shaped and includes two legs 15 and 16 which are substantially oriented at right angles to each other.

On the free end of the leg 16 an inclined surface 17 is formed which makes the insertion of the insulation element 4 easier with the mounting bracket 14 fixed to the profile.

The leg 15 of the mounting bracket 14 is provided on its free end with a seat 18 which is formed by crimping the free end of the leg 15 and which overlaps a free end of a leg of the profile 3 when the mounting bracket 14 is fixed to the profile 3 in accordance with its intended use.

In the transition zone from the leg 15 to the leg 16 an additional nose-like protrusion 19 is formed which overlaps the transition zone from the web to the leg of the profile 3, so that a form-fit or force-fit connection in the region of the protrusion 19 between the mounting bracket 14 and the profile 3 can be produced in addition to a form-fit connection in the region of the seat 18.

The mounting bracket 14 is made from a thin metal sheet having a material thickness of 0.6 mm and additionally includes a bead not to be seen in FIG. 6. Because of the bead the mounting bracket 14 has a sufficient bending stiffness, so that even insulation elements 4 from mineral fibers with higher bulk density can be securely supported by the mounting bracket 14 in the space between two mutually adjacent and parallel extending profiles 3.

The invention is not limited to the above-described embodiments of an under rafters insulation system. Various changes and modifications are possible within the scope of protection of the invention. For example the profile 3 may be also constructed as a box-like profile or it may have the form of a counter-lath, also from wood. The embodiment of an under rafters insulation system illustrated in the FIGS. 5 and 6 can be provided in addition to the under rafters insulation system according to the FIGS. 1 to 4. Moreover it is possible to secure the insulation elements 4 exclusively by mounting brackets 14 in the space between the adjacent profiles 3. In this case the legs 7 of the embodiments according to the FIGS. 1 to 4 are not important.

LIST OF REFERENCE NUMBERS

1 under rafters insulation system
2 rafters
3 profile
4 insulation element
5 holding element
6 screw connection
7 legs
8 web
9 arrows
10 screw connection
11 broken line
12 legs
13 bending point
14 mounting bracket
15 leg
16 leg
17 inclined surface
18 seat
19 protrusion

The invention claimed is:

1. Under rafters insulation system for a steep roof having rafters running parallel to each other in one direction, said system comprising:

at least two mutually spaced elongated building elements that extend underneath the rafters, said building elements extending perpendicular to the direction of the rafters;

insulation elements being arranged in a space between the building elements;

holding elements for mounting the building elements to said rafters of the steep roof, said holding element having a first leg and a second leg, the first leg being directly secured to the rafter, the second leg extending at a right angle to the first leg and being secured to a building element, and the second leg having a free end that is bendable from a first position substantially perpendicular to the first leg to a second position substantially parallel to the first leg to support underside portions of the insulation element.

2. Under rafters insulation system according to claim 1, wherein said holding elements are substantially U-shaped including a third leg extending substantially parallel to the second leg.

3. Under rafters insulation system according to claim 1, wherein said building elements are constructed as profiles having a substantially U-shaped cross section.

4. Under rafters insulation system according to claim 1, wherein said holding elements consist of a plastically deformable material.

5. Under rafters insulation system according to claim 1, wherein said holding elements are constructed as perforated metal sheets.

6. Under rafters insulation system according to claim 1, wherein said holding element is substantially L-shaped.

7. An insulation system for a roof having rafters running parallel to each other in one direction, said system comprising:

a plurality of spaced apart building elements, the building elements having a U-shaped profile with a pair of opposing legs connected by a web portion;

insulation between the building elements and being directly underneath the rafters; and holding elements for mounting the building elements to the rafters and for additionally supporting the insulation to prevent it from falling, said holding element having at least a first leg and a second leg, the first leg being directly secured to the underside of the rafter, the second leg extending at a right angle from the first leg and being secured to a leg of a building element, the second leg having a free end that is bendable from a first position substantially perpendicular to the first leg to a second position substantially parallel to the first leg to support underside portions of the insulation.

* * * * *